US005972870A

United States Patent [19]

Anderson

[11] Patent Number: 5,972,870

[45] Date of Patent: Oct. 26, 1999

[54] MULTI-LAYERED LAUNDRY TABLET

[75] Inventor: Michael R. Anderson, Boca Raton, Fla.

[73] Assignee: Vision International Production, Inc., Boca Raton, Fla.

[21] Appl. No.: 08/920,325

[22] Filed: Aug. 21, 1997

[51] Int. Cl.[6] ..... C11D 17/00

[52] U.S. Cl. ..... 510/298; 510/440; 510/446; 510/447

[58] Field of Search ..... 510/294, 298, 510/440, 446, 447

[56] References Cited

U.S. PATENT DOCUMENTS

| | | | |
|---|---|---|---|
| 4,219,435 | 8/1980 | Biard et al. | 510/439 |
| 4,253,842 | 3/1981 | Ehrlich | 8/137 |
| 4,460,490 | 7/1984 | Barford et al. | 510/192 |
| 4,576,727 | 3/1986 | Browne | 510/298 |
| 4,683,072 | 7/1987 | Holdt et al. | 510/192 |
| 5,133,892 | 7/1992 | Chun et al. | 510/224 |
| 5,198,198 | 3/1993 | Gladfelter et al. | 510/220 |
| 5,407,598 | 4/1995 | Olson et al. | 252/186.35 |
| 5,665,694 | 9/1997 | Backes et al. | 510/480 |
| 5,783,540 | 7/1998 | Secemski et al. | 510/224 |

FOREIGN PATENT DOCUMENTS 62-225600 10/1987 Japan .

*Primary Examiner*—Lorna M. Douyon
*Attorney, Agent, or Firm*—Malin, Haley, DiMaggio & Crosby, PA

[57] ABSTRACT

A chemical dispensing device comprising a dissolvable, multi-layered, laundry tablet for insertion in a washing machine at the initiation of the laundry washing process. The laundry tablet includes a dissolvable first or outer layer which includes an alkaline substance for raising the pH level of the wash water upon dissolving, and a dissolvable second or inner layer which includes an acidic substance for subsequently lowering or neutralizing the pH level of the wash water. The laundry tablet thus provides an effective device for automatically varying the pH level of the laundry wash water, which automatic variation is effected by the single step of depositing the tablet in the laundry wash water at the initiation of the wash cycle.

3 Claims, 3 Drawing Sheets

MULTI-LAYERED LAUNDRY TABLET

BACKGROUND OF THE INVENTION

1. Field of the Invention

The present invention relates to devices for use in cleaning laundry or dishes, and more particularly to a dispensing device and method for dispensing substances, such as chemicals, in water for use in the cleaning or treatment of laundry.

2. Description of the Background Art

Laundering of clothes and other fabrics to remove soil and other common contaminants is well known in the art, and is a part of daily living in many parts of the world. Prior to the mid twentieth century home laundering was a laborious task, usually consuming an entire day of work. Since World War II, however, great strides have been made in the convenience of home washing. The automatic washer and dryer revolutionized the chore of home laundering. Consequently, heating water to fill the washer, using the washer and wringer, and hanging linen and clothing to dry have become obsolete with the home laundering equipment now available. By merely loading clothes in a washing machine and adding detergent, the modern home machine automatically puts the clothes through a suds cycle and one or two rinse cycles. Thus, a person is freed to do other things while the wash is being done, and, instead of hanging the clothes to dry, a person can now remove them from the washer and quickly dry them in a dryer.

In the middle ages, soap was made at home and used for cleaning laundry. Cake soap, however, was a luxury product that came into common use only in the 19th century. The synthetic relatives of soap, detergents were developed during World War II when the natural ingredients for soap became scarce. Unlike soap, detergents are synthetics and do not form easily biodegradable waste products.

By the 1950's detergents had become more popular than soap for general laundering and dish washing since soap, when used in hard water (i.e. water that contains a large amount of dissolved mineral salts), reacts, unlike detergents, with the dissolved salts to form a whitish gray precipitate responsible for the common bathtub ring.

Sodium sulfonates make up the most common group of detergents. Sodium alkylbenzene sulfonate, or sodium ABS, was one of the earliest detergents. Its molecules comprise a long chain of hydrocarbons formed by linked carbon atoms having two hydrogen atoms attached to each carbon atom. The chain is not straight: the carbon atoms branch off at one end. This is the hydrophobic part that attaches to soil. Attachment to the soil is facilitated by the ionic attraction between the positively charged soil particles and the negatively charged hydrophobic end of the molecule. At the other end, a sodium sulfonate molecule attaches to water.

The detergents used for washing clothing also typically include a number of additives—for example, bleaches, brighteners, and abrasives. Bleaches whiten fabrics by destroying dirt and colors. Brighteners are chemicals that convert normally invisible ultraviolet light into visible light, such that additional light reflects back from the fabric, making it seem more vivid, or "whiter." Abrasives are ground-up particles of sand or other rock minerals added to detergents to scour stains.

The basic cleaning agents in detergents are called surface-active agents, or surfactants. When added to liquid, they reduce the liquids surface tension (the affinity that the liquid's surface molecules have for each other), thereby increasing the liquid's spreading and wetting properties. Part of the surface-active molecule is hydrophilic, or "water loving," and another part is hydrophobic, or water-repellant.

The seemingly simple action of cleaning a soiled surface is actually a complex four-step process. First, the surface to be cleaned is made wet. Soaps and detergents help the water spread out and wet the surface by penetrating the fabric fibers. Second, the surface absorbs the soap or detergent. The hydrophilic part of the surface-active molecule attaches itself to the water, and the hydrophobic part attaches itself to the solid or fiber, and most important, to the soil. In the third step, the soil is broken up into small beads that can be washed away. Mechanical agitation helps the surface-active molecules pull the dirt away from the material and into the water. Finally, the dirt is rinsed away in the water.

Furthermore, the acidity or pH level of laundry water has been found to enhance detergent cleaning effectiveness. An acid is a compound containing hydrogen which releases hydrogen ions (H+) in an aqueous solution. This causes the hydrogen atoms to become electrically charged ions with a strong tendency to react with other substances, hence, the corrosiveness of many acids. The acidity of a solution is thus based on the hydrogen ion concentration and is commonly referenced in terms of the solution's pH level. A neutral solution has a pH level of 7.0, while an acidic solution has a pH level below 7.0, and an alkaline or basic solution has a pH level higher than 7.0.

By adjusting the pH level of laundry water, it has been found that cleaning effectiveness can be greatly enhanced. Specifically, many commercial and industrial laundry cleaning systems utilize high pH laundry water solutions to improve cleaning performance. While high pH laundry water improves cleaning performance, it can also result in fabric discoloration and reduction in fabric tensile strength.

Accordingly, many commercial and industrial laundry processes utilize a two step process wherein the pH level of the laundry water is first raised to improve cleaning effectiveness, then reduced, or neutralized, to prevent discoloration and tensile strength reduction. The two step process is accomplished, either manually or automatically, by the addition of effective amounts of pH altering chemicals at predetermined periods. Thus, in addition to detergent formulations, an effective amount of very alkaline (e.g. high pH) ingredients are added, at high wash water temperatures (e.g. 160° –180° F.). Examples of such alkaline ingredients include soda ash, silicates and various other caustic ingredients in addition to various phosphate blends. In the second step of the process, acidic blends, known as "laundry sours" are added to reduce the alkaline pH of the wash water for preventing fabric discoloration and tensile strength reduction. Examples of such laundry sour ingredients include sodium silico-fluorides and sodium biflourides.

This process, however, is not practical in non-commercial, household laundry cleaning applications since consumers are generally not willing to attend to the addition of multiple chemical compositions at various time intervals during a single wash cycle requiring the consumer to constantly monitor the wash cycle. Thus, commercially available laundry detergents marketed and sold for home use comprise pH neutral detergent solutions. Accordingly, the cleaning effectiveness of commercially available home laundry detergents is not fully realized. Thus, there exists a need for an apparatus and method for varying the pH level of laundry water in a predetermined manner without requiring the user to repeatedly add chemicals during the washing process.

SUMMARY OF THE INVENTION

The present invention addresses many disadvantages present in the background art by providing a chemical dispensing device comprising a dissolvable, concentrically-layered, laundry tablet for insertion in a washing machine at the initiation of the laundry washing process. The laundry tablet includes a dissolvable first or outer layer which includes an alkaline substance for raising the pH level of the wash water upon dissolving, and a dissolvable second or inner layer which includes an acidic substance for subsequently lowering or neutralizing the pH level of the wash water. The laundry tablet thus provides an effective device for automatically varying the pH level of the laundry wash water, which automatic variation is effected by the single step of depositing the tablet in the laundry wash water at the initiation of the wash cycle.

In the preferred embodiment, a laundry tablet according to the present invention comprises a spherical, concentrically-layered, dissolvable structure formed of compressed powder wherein an outer layer is formed from an alkaline substance, and an inner layer is formed from an acidic substance. The laundry tablet is designed to dissolve at a predetermined rate, dependent upon the duration of the wash cycle, and the outer layer functions to raise the pH level of the wash water upon dissolving, while the inner layer functions to reduce the pH level of the wash water upon dissolving. The outer layer comprises a suitable alkaline substance capable of raising the pH level of the wash water to a pH level of between 8 and 14 upon dissolving, and may also include powdered detergent. The inner layer comprises a suitable acidic substance capable of reducing the pH level of the wash water to approximately 7, by dissolving into solution after the outer layer has dissolved.

The following alternate embodiments of the laundry tablet are also contemplated. In a first alternate embodiment, the outer layer includes an external coating of dissolvable material to prevent the alkaline substance associated with the dissolvable outer layer from irritating the user's skin during handling. The external coating may be any suitable material and functions to allow the user to handle the laundry tablet without contacting the enclosed alkaline substance. The external coating should be relatively thin and capable of dissolving or breaking down rapidly upon exposure to water. The external coating may be a compressed powder or a gel-type coating having a generally neutral pH of approximately 7.0. In a second alternate embodiment, a third, innermost layer is contemplated, which innermost layer may comprise a water softening agent, fragrance substance, or any suitable treatment substance. In a third alternate embodiment, the laundry tablet may comprise an outer layer of pH neutral (e.g. pH=7) detergent and an inner layer comprising a water and/or fabric softener and/or fragrance substance.

Use of the laundry tablet of the present invention includes depositing the tablet in a laundry cleaning machine, such as a clothes washing machine, at the initiation of the fill and/or wash cycle. Upon insertion, the tablet layers are exposed to the wash water and the tablet is allowed to sequentially dissolve. Each dissolving layer contributes to the laundry cleaning process by effecting the chemical composition and properties of the laundry wash water. In the preferred embodiment, each layer comprises the respective active substances in compressed powder form in an effective quantity to yield the desired results. The rate that each layer dissolves is dependent upon the compressive force used to form the layer. Thus, laundry tablets according to the present invention may be manufactured with multiple layers, each containing a different substance, which sequentially dissolve at controlled rates. In the preferred embodiment, the tablet should fully dissolve prior to the termination of the wash cycle.

In accordance with these and other objects which will become apparent hereinafter, the instant invention will now be described with particular reference to the accompanying drawings.

DESCRIPTION OF THE PREFERRED EMBODIMENTS

Figure 1:
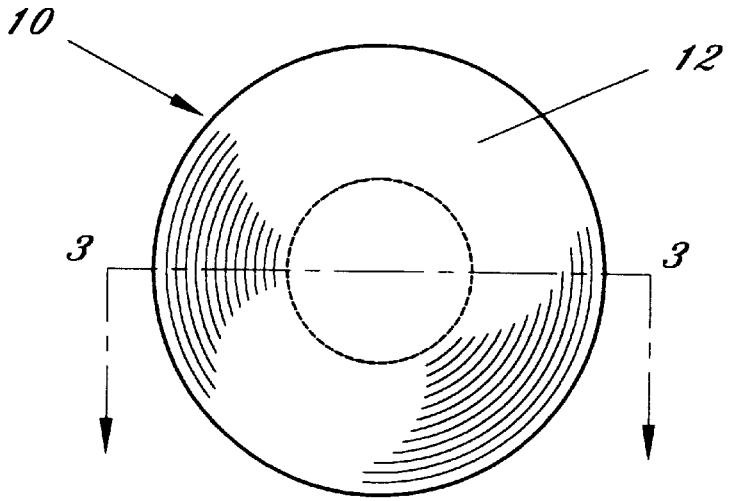
FIG. 1 is a side view of a preferred embodiment of the laundry tablet.
Figure 2:
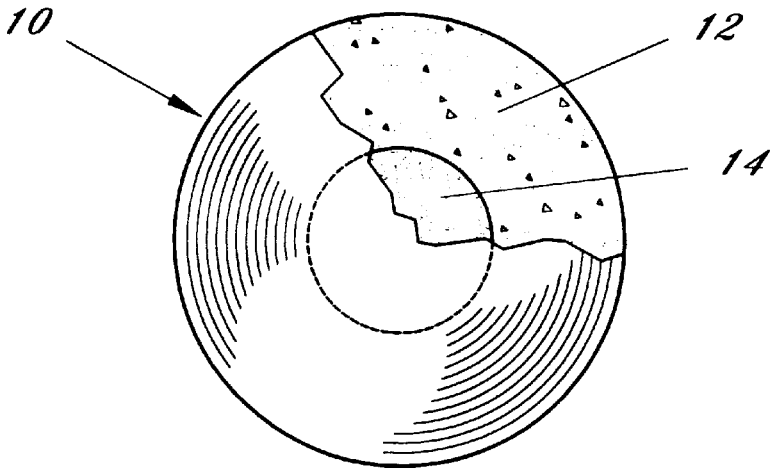
FIG. 2 is a side view, partially cut-away, of the laundry tablet depicted in FIG. 1.
Figure 3:
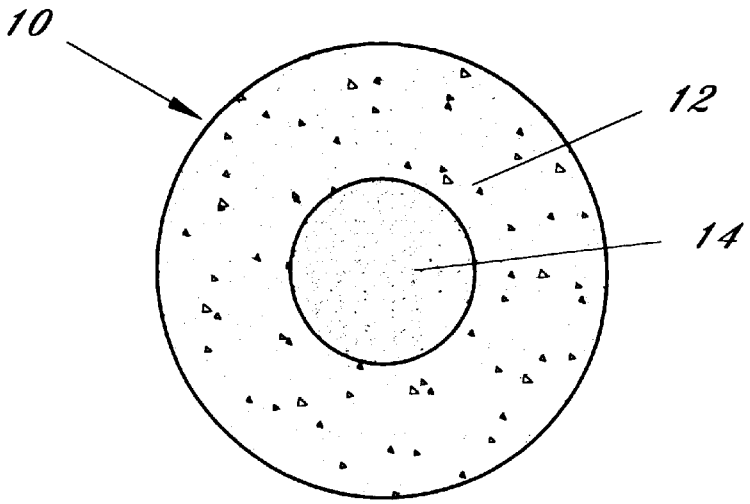
FIG. 3 is a side sectional view of the laundry tablet depicted in FIG. 1.

FIGS. 1–3 depict an embodiment of the chemical dispensing device, embodied in the form of a dissolvable tablet generally referenced as 10, for enhancing the cleaning effectiveness in a laundry cleaning process. In the preferred embodiment, tablet 10 comprises a spherical, concentrically-layered, dissolvable structure formed of compressed powder having an outer layer 12 which includes an alkaline substance, and an inner core layer 14 which includes an acidic substance. The tablet 10 is designed to dissolve at a predetermined rate when submerged in a fluid, such as water, which rate typically depends upon the duration of the wash cycle. The outer layer 12 of tablet 10 functions, by dissolving, to raise the pH level of the wash water, while the inner layer 14 functions, by dissolving, to reduce the pH level of the wash water. While the preferred embodiment of tablet 10 is disclosed as having a spherical shape, any suitable layered three dimensional shape is considered within the scope of the present invention. It is important, however, that, regardless of shape, that an outer layer is first exposed and dissolved in water, thereby exposing an inner layer(s) which subsequently dissolves. The instant invention further contemplates a series of layers (e.g. 3, 4, etc.), each of which would include a dissolable substance for achieving a particular desired result.

In the preferred embodiment, outer layer 12 includes an effective quantity of a suitable alkaline substance capable of raising the pH level of the wash water to a pH level of between 8 and 13 by dissolving into solution. An example of a suitable alkaline substance is soda ash. The cleaning effectiveness of the laundry cleaning process is enhanced by the use of wash water having an elevated pH level. In addition, outer layer 12 may include detergent, such that all of the essential ingredients are present in a convenient, pre-measured package which provides all of the necessary and/or desirable chemicals for the laundry cleaning process suitable for one-step insertion.

Inner layer 14 includes an effective quantity of a suitable acidic substance capable of reducing the pH level of the wash water, from the elevated level achieved by the dissolved outer layer, to approximately 7.0, by dissolving into solution after outer layer 12 has dissolved and thus has exposed inner layer 14. Accordingly, the pH level of the wash water is reduced to a generally neutral level prior to termination of the wash cycle for preventing discoloration and reduction in fabric tensile strength. An example of a suitable acidic substance is sodium bifluoride or sodium fluosilicate.

Each dissolving layer, 12 and 14, sequentially contributes to the laundry cleaning process. In the preferred embodiment, each layer comprises the respective active substances in compressed powder form in an effective quantity to yield the desired results. For example, it has been found that an outer layer containing approximately 9 oz. of commercial grade, alkaline, detergent, and an inner layer containing approximately 3 oz. of acidic powder, is effective in a commercial laundry process for 100 lbs. of dry clothes.

The rate that each layer dissolves is generally dependent upon the compressive force or pressure used to form the layer. Thus, laundry tablets according to the present invention may be manufactured with multiple layers which dissolve at controlled rates. In the preferred embodiment, the tablet should fully dissolve prior to the termination of the wash cycle so that no evidence of the tablet remains in the washing machine after the conclusion of the spin cycle.

Use of the laundry tablet of the present invention includes depositing tablet 10 in a clothes washing machine at the initiation of the fill or wash cycle, wherein the outer layer 12 is initially exposed to wash water such that the outer layer 12 dissolves thereby raising the pH level of the wash water. Once the outer layer 12 has dissolved, the inner layer 14 is exposed to the wash water and also dissolves thereby lowering the pH level of the wash water to a relatively neutral level.

Figure 4:
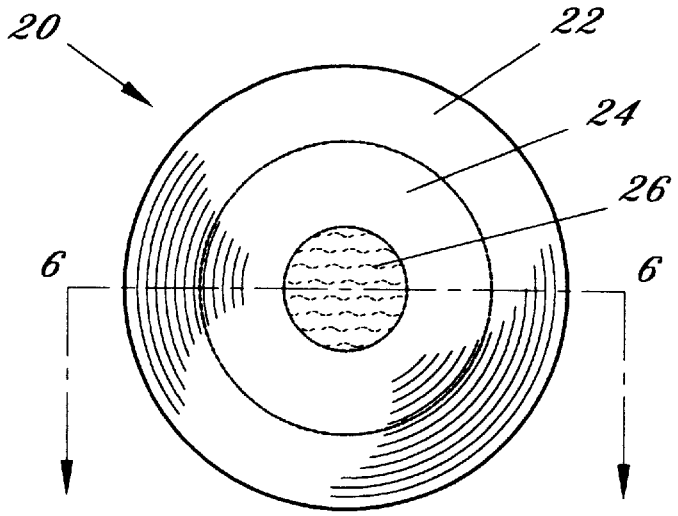
FIG. 4 is a side view of an alternate embodiment of the laundry tablet.
Figure 5:
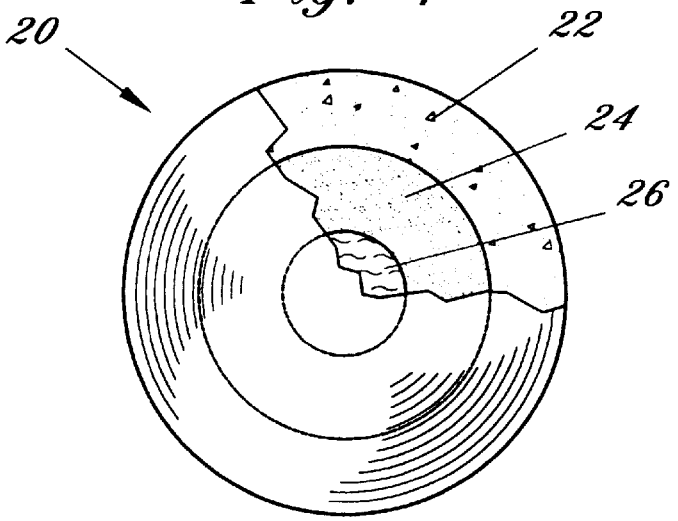
FIG. 5 is a side view, partially cut-away, of the laundry tablet depicted in FIG. 4.
Figure 6:
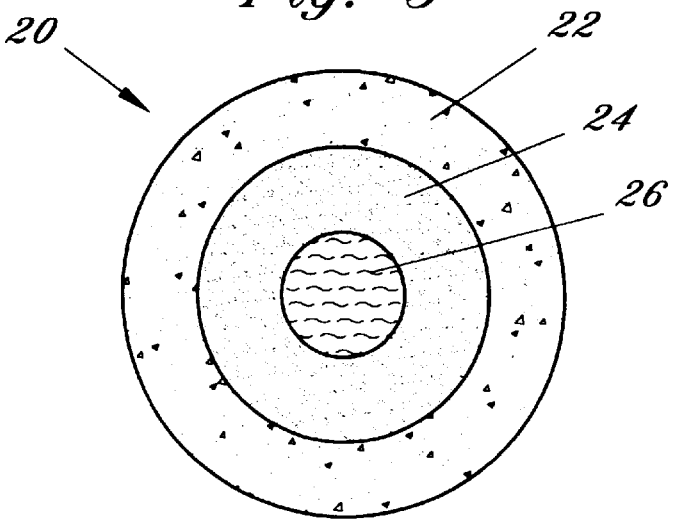
FIG. 6 is a side sectional view of the laundry tablet depicted in FIG. 4.
Figure 8:
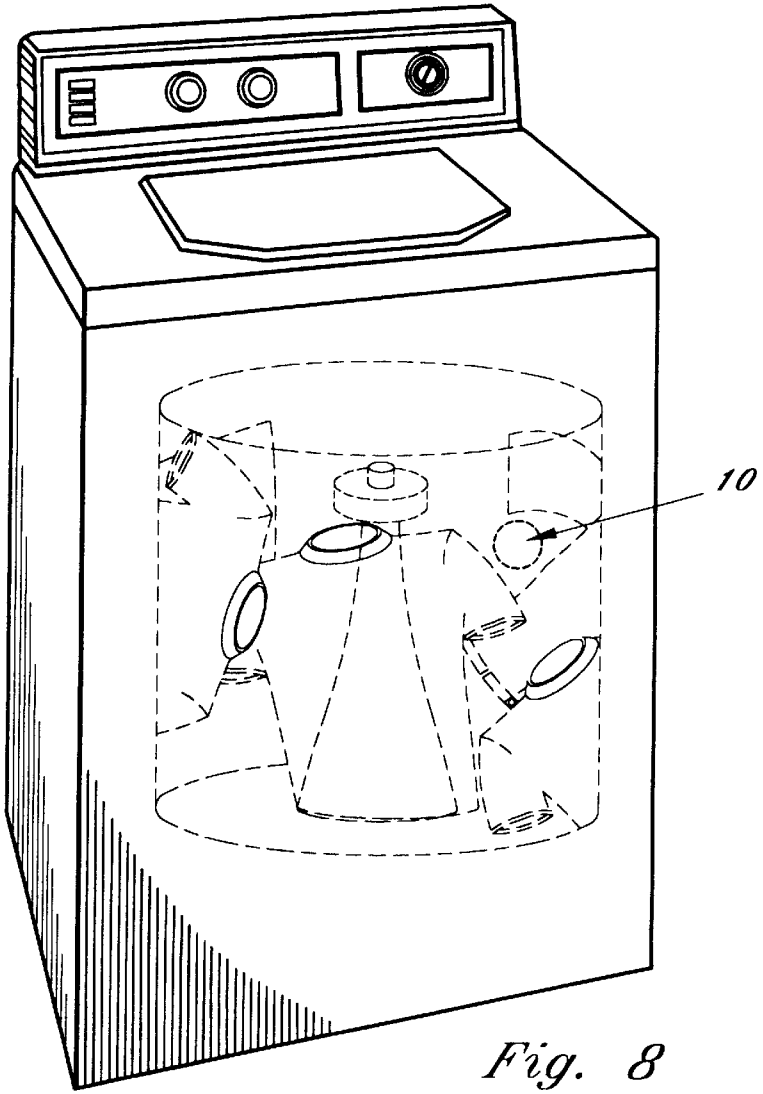
FIG. 8 is a perspective view of an embodiment of the present invention disposed in a laundry machine.

The following alternate embodiments are also contemplated. A first alternate embodiment, generally referenced as 20 in FIGS. 4–6, comprises a first layer 22, a second layer 24, and a third layer 26. In this first alternate embodiment, first and second layers 22 and 24 may include an alkaline substance and an acidic substance respectively as disclosed herein above. In addition, third layer 26 may include a water or fabric softening agent, fragrance substance, or any suitable treatment substance. In FIGS. 4–6, third layer 26 is depicted as comprising a fluid, however, it may comprise a compressed powder as previously disclosed herein.

In a second alternate embodiment (not shown), the device may comprise an outer layer of pH neutral (e.g. pH=7.0) detergent and an inner layer comprising a water and/or fabric softener and/or fragrance substance.

Figure 7A:
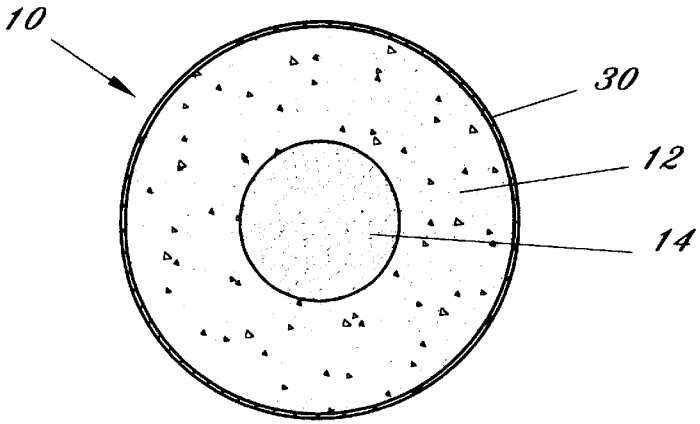
FIG. 7*a* is a side sectional view of an alternate embodiment.
Figure 7B:
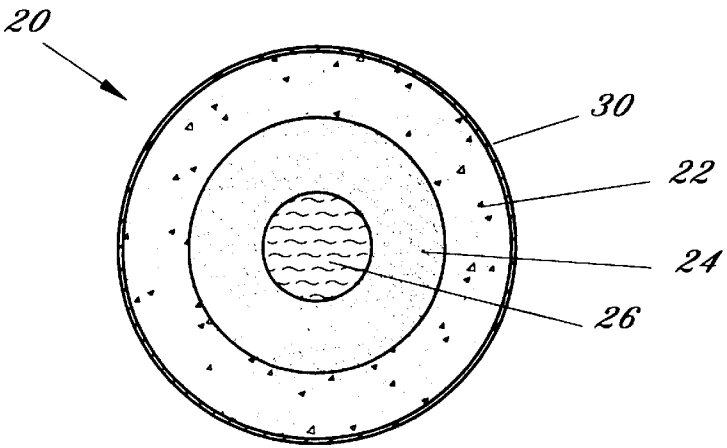
FIG. 7*b* is a side sectional view of yet another alternate embodiment.

In a third alternate embodiment, depicted in FIGS. 7*a* and 7*b*, the device includes an external coating 30. Coating 30 comprises a protective layer of material which rapidly dissolves upon exposure to water to prevent the alkaline substance forming the outer layer, 12 or 22, from irritating the user's skin during handling. External coating 30 may be any suitable material and functions to allow the user to handle the laundry tablet without contacting the enclosed alkaline substance. External coating 30 should be relatively thin and capable of dissolving or breaking down rapidly upon exposure to water. The external coating may be a compressed powder or a gel-type coating having a generally neutral pH of approximately 7.0.

In yet another alternate embodiment, the present invention may be adapted for use in other applications. For example, the invention contemplates a multi-layered tablet embodiment for use in automatic dishwashing applications. Specifically, a dishwashing embodiment is contemplated wherein an outer dissolvable layer includes an effective quantity of dishwashing detergent and an inner dissolvable layer includes an effective quantity of anti-sheeting substance known in the art for enhancing spot free drying.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A multi-layered laundry tablet for use in a washing machine comprising a first dissolvable layer including an alkaline substance for initially raising the pH level of water to between 8.0 and 14.0, and a second dissolvable layer including an acidic substance selected from the group consisting of sodium bifluoride and sodium fluosilicate for lowering the pH level of water to approximately 7.0, said second dissolvable layer being concentrically disposed within and adjacent to said first dissolvable layer.

2. A tablet according to claim 1, further including a core, disposed within said second dissolvable layer, said core comprising a dissolvable substance including at least one of the following: a water softener; a fabric softener; a fragrance.

3. A tablet according to claim 1, further including a dissolvable, protective outer coating.

* * * * *